US005170575A

United States Patent [19]

Pelfrey

[11] Patent Number: 5,170,575

[45] Date of Patent: Dec. 15, 1992

[54] FOOTBALL KICKING SHOE

[76] Inventor: Raymond Pelfrey, P.O. Box 2747, Sparks, Nev. 89423

[21] Appl. No.: 512,456

[22] Filed: Apr. 23, 1990

[51] Int. Cl.[5] ..... A43B 5/02; A43B 5/12

[52] U.S. Cl. ..... 36/133; 36/128; 36/113

[58] Field of Search ..... 36/50, 51, 103, 88, 36/107, 104, 105, 106, 93, 113, 43, 44, 25 R, 78, 7.8, 114, 71, 133, 129, 128

[56] References Cited

U.S. PATENT DOCUMENTS

| | | | |
|---|---|---|---|
| 1,620,797 | 3/1927 | Bonaventure | 36/44 |
| 1.889,275 | 11/1932 | Domahoski | 36/113 |
| 2.904,903 | 9/1959 | Kardon | 36/128 |
| 3.797,137 | 3/1974 | Harkness | 36/113 |
| 3,964,181 | 6/1976 | Holcombe, Jr. | 36/25 R |
| 4.041,619 | 8/1977 | Sapper | 36/103 |
| 4,149,325 | 4/1979 | Pelfrey | 36/133 |
| 4,453,996 | 6/1984 | Terlizzi, Jr. et al. | 36/113 |
| 4,519,148 | 5/1985 | Sisco | 36/103 |
| 4,617,746 | 10/1986 | Hannah | 36/133 |
| 4,813,158 | 3/1989 | Brown | 36/114 |
| 4,901,453 | 2/1990 | Gaynor | 36/113 |

*Primary Examiner*—Steven N. Meyers
*Attorney, Agent, or Firm*—Larson & Taylor

[57] ABSTRACT

A football kicking shoe is provided having a sole with the toe portion extending angularly downward with respect to the substantially flat instep and heel portion of the sole. The sole is sufficiently flexible so that when worn by a punter the sole will lie flat against the ground due to the pressure of the weight of the wearer and when the foot is raised, the toe portion of the sole will extend downwardly so as to present the upper surface of the shoe for contact with the football. The heel portion of the upper of the shoe has a convave cutout so as to permit the toes to be depressed without muscular effort on the part of the wearer of the shoe.

7 Claims, 1 Drawing Sheet

Fig. 1
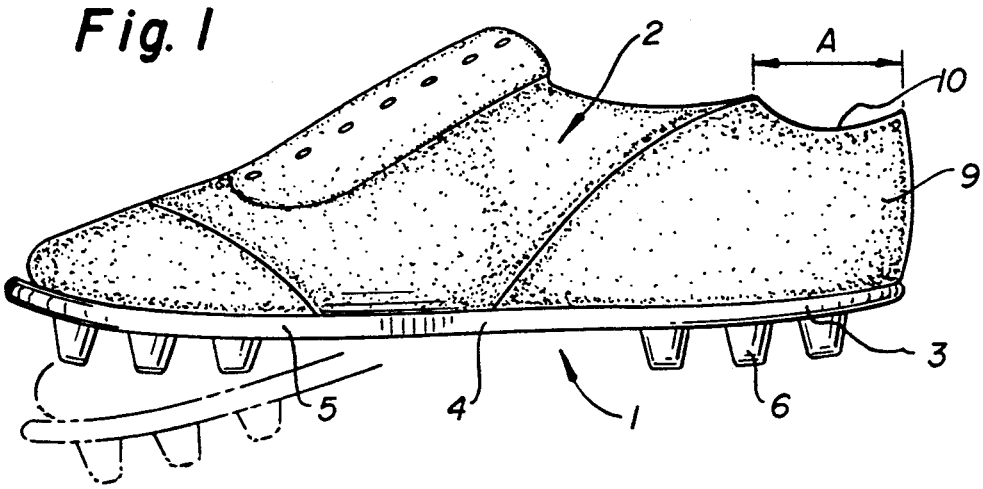
Fig. 2
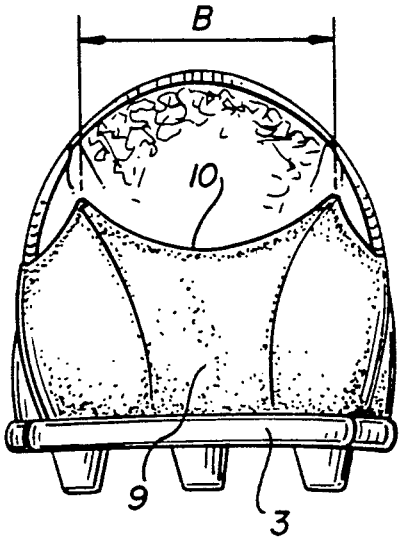
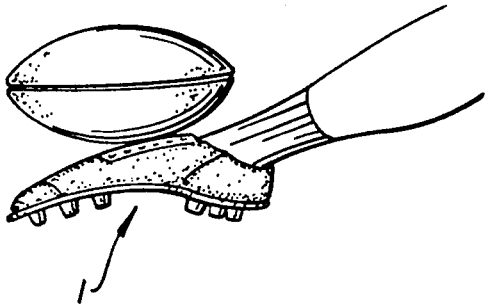
Fig. 4
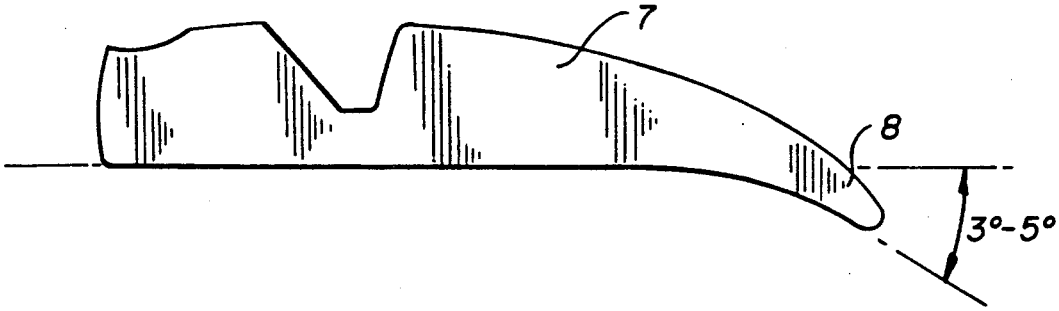
Fig. 3

FOOTBALL KICKING SHOE

The present invention relates to an athletic shoe which is particularly designed for use by football kickers and the like.

BACKGROUND OF THE INVENTION

Heretofore football punters have used conventional football shoes during kicking. The problems with punting using conventional shoes is that the punter must use great force to depress the toes of the foot so as to present the upper surface of the foot for contact with the ball. The extra effort expended in forcing the toes downwardly and maintaining the toes in that position during punting detracts from the energy which the kicker should apply to actually punting the ball. The structure of the conventional football shoe makes it highly difficult for the punter to force the shoe into a shape wherein the toe area of the shoe extends angularly downward with respect to the heel and instep portion of the shoe.

Some football punters have avoided this problem by kicking without any shoe. However, kicking barefoot obviously exposes the foot to injury. Hitting the ball, on a punt, when the toe is not depressed allows the toe of the shoe to make contact with the ball, negating a smooth spiral effect to the ball. The result is a poor punt.

SUMMARY OF THE INVENTION

According to the present invention, there is provided an athletic shoe for a football punter in which the normal state of the shoe is with a depressed toe area so that the punter does not need to exert any effort to depress the toes during the punting motion. This is achieved by making the shoe with the toe portion of the sole angularly depressed with respect to the flat heel and instep portion of the sole. The upper of the shoe has a concave cutout in the upper edge of the heel portion of the upper and the concave cutout extends along the sides of the upper edges of the shoe upper so as to eliminate any restrictions on the movement of the foot to depress the toes during the kicking exercise. When the foot is planted on the ground, the sole has sufficient flexibility so that the toe portion of the sole will lie in a flat plane with the heel and instep portions of the sole. However, as soon as the foot is raised from the ground, the toe portion of the sole will assume a depressed angular position with respect to the instep and heel portions of the sole.

An object of the present invention is to provide a punting shoe wherein the toe portion of the sole is angularly depressed with respect to the instep and heel portions of the sole.

Another object of the present invention is to provide a punting shoe wherein the heel portion of the upper of the shoe has a concave cutout portion therein which provides for greater flexibility in movement of the foot to a punting position.

Other objects and many of the attendant advantages of the present invention will become more readily apparent upon consideration of the following detailed specification together with the accompanying drawings wherein:

DESCRIPTION OF THE DRAWINGS

FIG. 1 is a side elevation of a punting shoe according to the present invention with the forward portion of the sole of the shoe shown in dotted lines when the shoe is raised from the ground, FIG. 2 is a rear elevation of the shoe shown in FIG. 1, FIG. 3 is a side elevational view of a last for forming a shoe according to the present invention, and FIG. 4 is a partial elevational view of a punting shoe according to the present invention positioned to kick a football.

DETAILED DESCRIPTION OF A PREFERRED EMBODIMENT

In FIG. 1 there is shown an athletic shoe with the sole shown at 1 and the upper shown at 2. The sole of the shoe comprises a heel portion 3, instep portion 4 and toe portion 5. The shoe is provided with cleats 6.

The shoe according to the present invention is formed on a last 7 as shown in FIG. 3. The last is formed of a plastic and has a angularly depressed toe portion 8. The angle of depression of the toe portion with respect to the plane of the instep and heel portions of the sole is greater than 0.5° and within a range of 0.5° to 10°, most preferably within the range of 3° to 5°. When the shoe is formed on the last 7 in a conventional manner, the toe portion 5 of the sole 4 will assume the depressed position shown in dotted lines in FIG. 1. However, when the shoe is worn and the wearer presses the foot against the ground the shoe will assume the normal horizontal plane shown in FIG. 1. As shown in FIG. 4, the punting shoe according to the present invention will assume the depressed toe configuration which is essential when punting a football. By providing a shoe which has a normal depressed toe condition, the punter will not need to exert muscular effort to force the toes downwardly to the correct kicking position.

The heel portion 9 of the upper 2 has a concave cutout as shown at 10 in FIGS. 1 and 2. The concave cutout 10 extends approximately one inch from the heel of the upper forward along the side of the shoe as shown at A in FIG. 1. The width of the concave depression 10 is shown at B in FIG. 2 and extends across the heel and sides of the shoe approximately an inch and a half. The concave cutout along the upper edge of the rear portion of the upper permits freer movement of the foot so a to permit the toe portion of the sole to readily move to the depressed angular position when the foot is raised off the ground as shown in FIG. 4.

Obviously many modifications and variations of the present invention are possible in light of the above teachings.

What is claimed as new and is desired to be secured by Letters Patent is:

1. A shoe for football punters comprising a sole, an upper secured to said solve having a kicking surface in the toe area of the upper, said hole having integral heel, instep and toe portions, said sole and upper being formed on a last having a downwardly extending toe portion with respect to a horizontal instep and heel portion, said heel and instep portions of said sole being substantially flat and lying in the same horizontal plane and said toe portion of said sole extending downwardly with respect to the horizontal plane of the heel and instep portions of said sole, said sole being sufficiently resilient to cause the toe portion of the sole to lie in the same plane as the heel and instep portions of the sole when the weight of a person wearing the shoe presses the sole against a flat surface whereas the toe portion of the sole will assume a downward angular position with respect to the heel and instep portions of the sole when the shoe is raised from the flat surface whereby the kicking surface on the top of the foot is positioned for proper contact with a ball.

2. A shoe according to claim 1 wherein the toe portion of the sole extends downwardly from the plane of the instep and heel portions of the shoe at an angle greater than 0.5°.

3. A shoe according to claim 1 wherein the toe portion of the sole extends downwardly from the plane of the instep and heel portions of the shoe at an angle between 0.5° and 10°.

4. A shoe according to claim 1 wherein the upper has a heel portion with the upper edge of the upper having a concave cutout extending across the heel portion and along the sides of the upper a substantial distance.

5. A shoe according to claim 4 wherein the concave cutout portion of the upper edge of the heel portion of the upper extending approximately one inch along each side of the heel portion of the upper.

6. A shoe according to claim 1 and further including means in the upper of the shoe to provide sufficient flexibility to permit the wearer to obtain maximum toe depression when the foot is raised.

7. A shoe according to claim 1 wherein the toe portion of the sole extends downwardly from the plane of the instep and heel portions of the shoe at an angle between 3° to 5°.

* * * * *